US005081792A

United States Patent [19]

Huebner

[11] Patent Number: 5,081,792

[45] Date of Patent: Jan. 21, 1992

[54] WINDOW REGULATOR WITH ORTHOGONAL PUSHOUT FOR FLUSH WINDOW

[75] Inventor: Mark A. Huebner, St. Clair Shores, Mich.

[73] Assignee: Wickes Manufacturing Company, Southfield, Mich.

[21] Appl. No.: 482,892

[22] Filed: Feb. 22, 1990

[51] Int. Cl.[5] ..... E05D 15/10

[52] U.S. Cl. ..... 49/221; 49/349; 49/375

[58] Field of Search ..... 49/211, 221, 225, 349–352, 49/374, 375

[56] References Cited

U.S. PATENT DOCUMENTS

| | | | |
|---|---|---|---|
| 1,085,877 | 2/1914 | Auscher | 49/352 X |
| 1,206,052 | 11/1916 | Ternstedt . | |
| 2,979,327 | 4/1961 | Swanson et al. | 268/124 |
| 4,759,653 | 7/1988 | Maekawa et al. | 49/352 X |
| 4,785,582 | 11/1988 | Tokue et al. | 49/352 |
| 4,819,377 | 4/1989 | Bauer et al. | 49/221 |
| 4,829,711 | 5/1989 | Sambor | 49/211 |

FOREIGN PATENT DOCUMENTS

| | | | |
|---|---|---|---|
| 1027940 | 11/1964 | United Kingdom | 49/352 |
| 2113294 | 7/1983 | United Kingdom | 49/352 |

*Primary Examiner*—Gary L. Smith
*Assistant Examiner*—Jerry Redman
*Attorney, Agent, or Firm*—David A. Greenlee

[57] ABSTRACT

A guide attached to a vehicle window slides along a slotted vertical track and is pulled by a cable to raise and lower the window. A pulley-like cable holder is rotatably mounted on the guide and the cable is wrapped on the holder to impose a rotational moment on the holder. The holder carries a pin which rides in the track slot to prevent rotation during window raising and lowering so that only vertical movement occurs. A lateral slot arm extending from the slot receives the pin when the window is fully raised and allows the holder to rotate. A cam responsive to the holder rotation moves the window horizontally to or from its outer closed position.

4 Claims, 3 Drawing Sheets

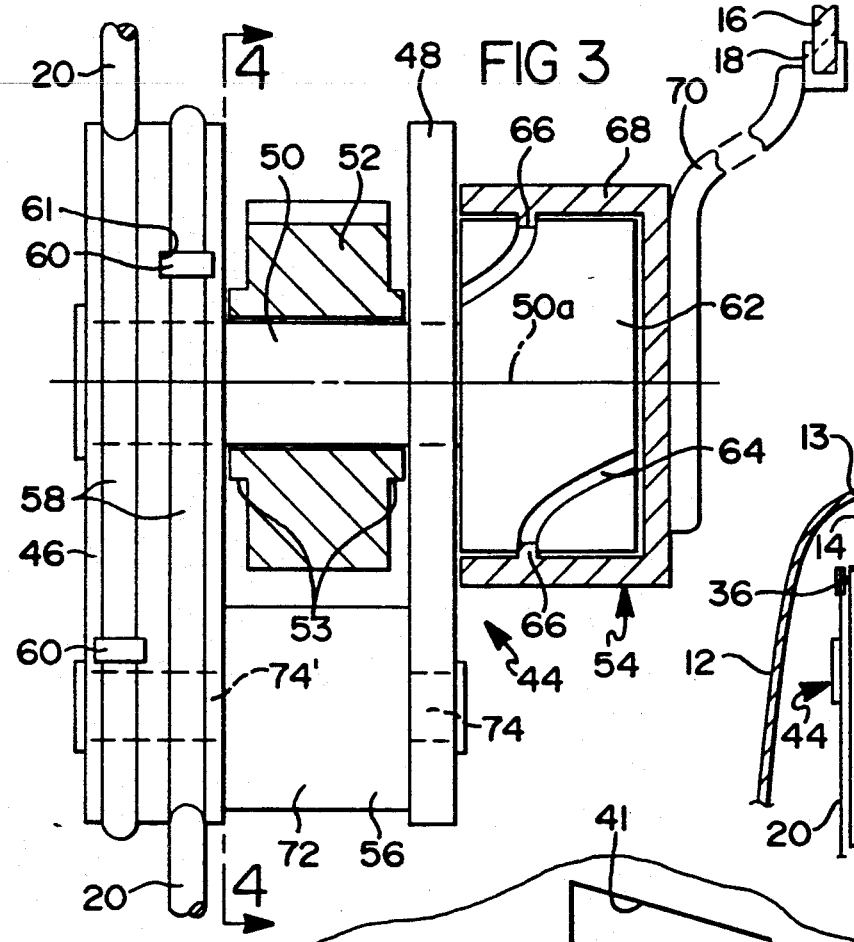
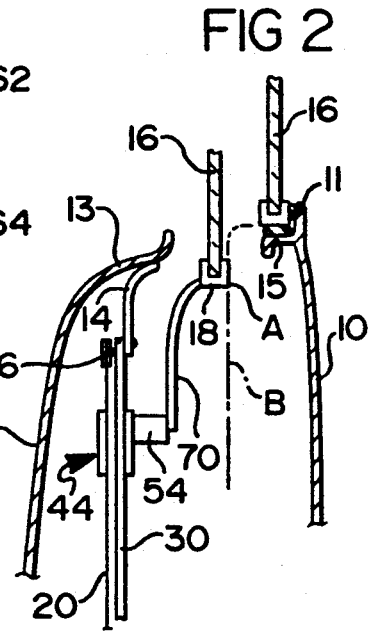
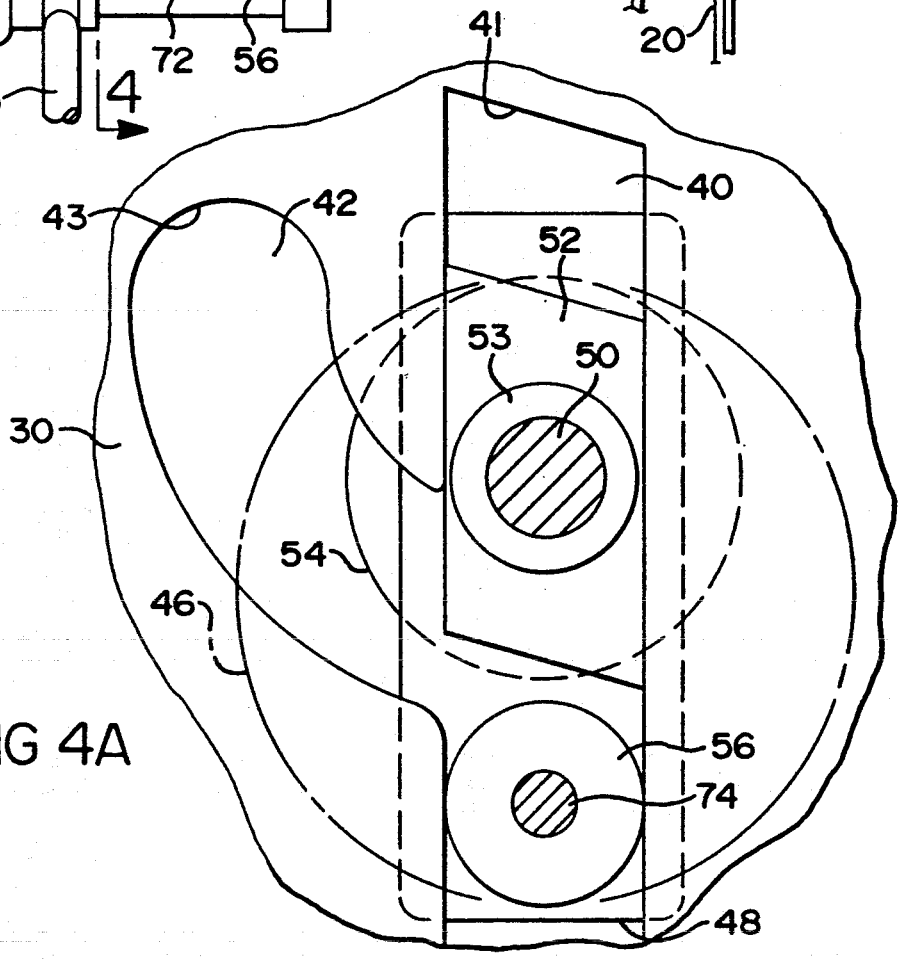
FIG 4A

WINDOW REGULATOR WITH ORTHOGONAL PUSHOUT FOR FLUSH WINDOW

FIELD OF THE INVENTION

This invention relates to regulators for vehicle windows and particularly for windows substantially flush with the outside vehicle surface.

BACKGROUND OF THE INVENTION

Modern vehicle doors are thin, minimizing the space available for a window regulator, and the doors have a smooth curved outer surface in which the windows when closed are substantially flush with the outside surface. Since the windows and the doors in such vehicles are not flat but have curvature, when the windows are opened they often require more space between the inner and outer panels of the door and thus further restrict the amount of space remaining for the regulator mechanism. In order to mount the regulator mechanism in the available space, to control the path of the window and to minimize the upper opening between the inner and outer door panels, it is desirable to move the window horizontally during the final closing movement. To move the bottom of the window to a flush position, it is sometimes necessary to clear a lip on the window opening or support brackets by moving the window outwardly after its full upward position has been reached. That is, substantially vertical window closing movement is followed by substantially horizontal movement to define a right angle path of motion.

Window closing movements in the upward and outward direction have long been known and various camming mechanisms have been proposed to achieve that result. U.S. Pat. No. 1,206,052 to Ternstedt uses a slotted cam plate with a compound curvature and a chain-driven cam follower to guide the window movement simultaneously upwardly and outwardly and then downwardly to finally close the window.

U.S. Pat. No. 4,819,377 to Bauer et al discloses a single track regulator having a slot with a bifurcated upper end and a pulley with two projecting pins engaged in the slot for upward movement in the track. A drive cable is wrapped around the pulley to pull the pulley along the track and to impose a moment on the pulley so that the pins are driven into the bifurcated slot portions to rotate the pulley during the final upward closing movement. The pulley is drivingly coupled to the window through a helical cam which moves the window outward when the pulley rotates so that the path of the window has both upward and outward components at the time of closing. Thus each of these patents results in a sloped path of window travel due to simultaneous vertical and horizontal movement.

U.S. Pat. No. 2,979,327 to Swanson et al discloses regulator mechanism which is very space consuming, but achieves substantially full upward movement followed by outward movement of the window. That mechanism employs dual guide tracks on each side of the window with a follower wheel in each of the four tracks. Two of the tracks having outwardly turned paths which effect outward window movement when the follower wheels reach the turns in the tracks.

SUMMARY OF THE INVENTION

It is therefore an object of the invention to provide an improved regulator which achieves sequential upward and outward motions in the final closing period and which is more compact than the prior art regulators. In particular, it is an object to improve on the regulator of U.S. Pat. No. 4,819,377 to Bauer et al by a mechanism for sequential upward and outward motion during window closing to obtain an orthogonal path of movement for the bottom of the window.

The invention is carried out by a window regulator for an automotive vehicle having flush windows comprising: a track and a vertical elongated slot in the track, the slot having an upper end and a lateral arm branching from the slot at a point below the upper end, a cable drive mechanism, upper guide means disposed in the slot for movement therein, a cable guide rotatably secured to the upper guide means at a pivot axis, a cable controlled by the drive mechanism and having a substantially vertical reach adjacent the slot, the cable being connected to the cable guide for developing a rotational moment on the cable guide as well as for exerting a vertical pull on the cable guide, lower guide means secured to the cable guide and spaced from the upper guide means for alignment with the lateral arm when the upper guide means is at the upper end of the slot, the lower guide means being disposed in the slot during window raising and lowering for preventing rotation of the cable guide and, when the window is fully raised, for movement into the lateral arm of the slot for rotation of the cable guide about the pivot axis, and a cam mechanism secured to the cable guide for rotation therewith about the pivot axis and coupled to the window for moving the window vertically during vertical cable guide movement along the track and, when the upper guide is seated at the upper end of the slot, for moving the window horizontally during cable guide rotation.

BRIEF DESCRIPTION OF THE DRAWINGS

The above and other advantages of the invention will become more apparent from the following description taken in conjunction with the accompanying drawings, wherein like references refer to like parts and wherein:

FIG. 2 is a cross-sectional front elevational view of a door, illustrating the opening between inner and outer door panels and the path of the window during closing;

FIG. 3 is a partly broken away front elevational view of the slide mechanism of the regulator, according to the invention; and FIGS. 4A, 4B and 4C are sequential cross-sectional views of the slide mechanism taken along line 4—4 of FIG. 3, illustrating different window positions.

DESCRIPTION OF THE INVENTION

Figure 1:
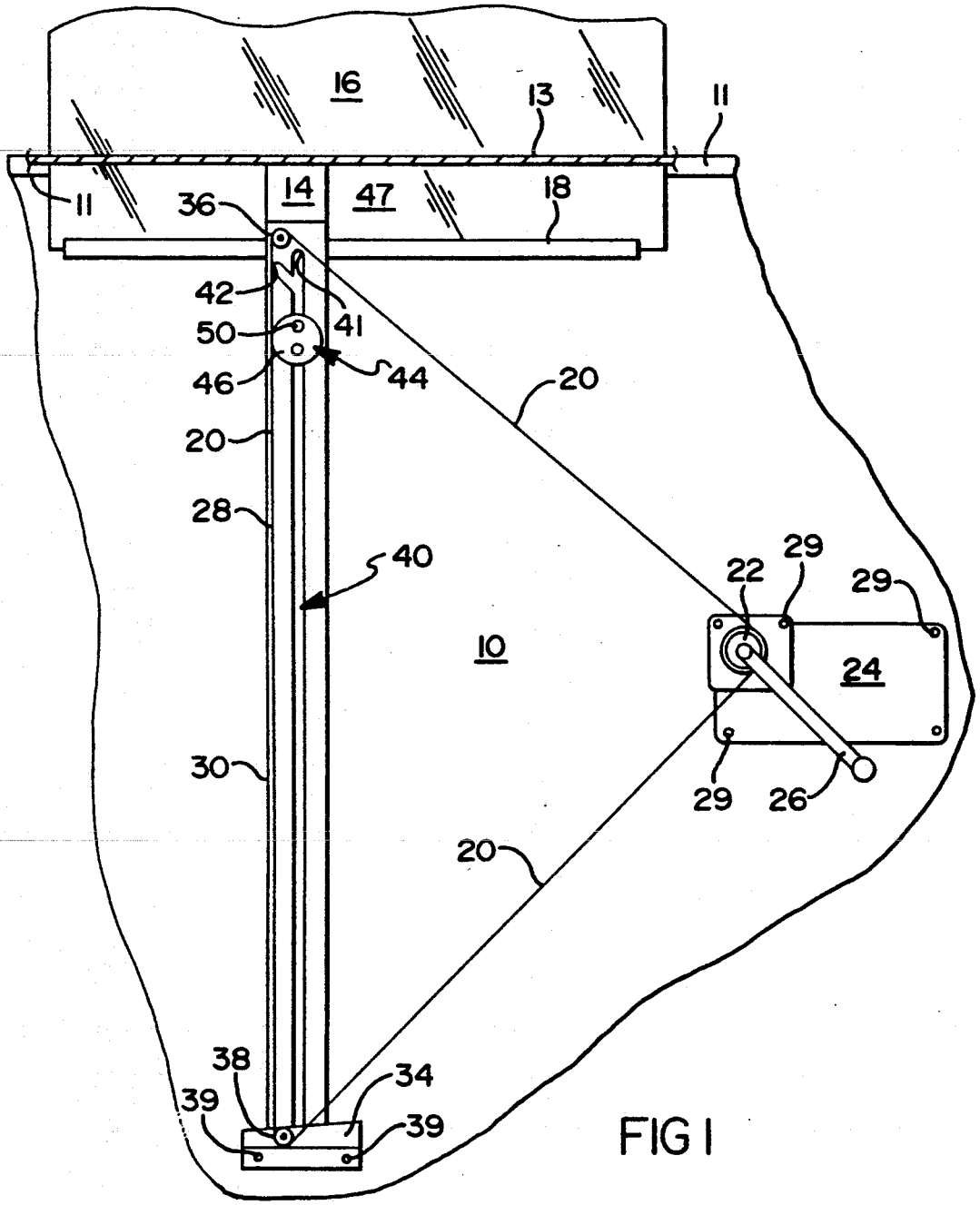
FIG. 1 is a partly broken away side elevation of a door panel with the window regulator according to the invention mounted thereon.

The invention is described in the context of a window movable in the generally vertical direction in a vehicle door. Since the door and the window may be curved, the window movement usually is not in a true vertical direction. The term "vertical" is herein used to refer to the upward and downward direction of window movement.

Since this invention is directed primarily to the mechanism for operating a window in a vehicle door, most of the parts of the door have been broken away in the drawings. However, in FIGS. 1 and 2, sections of the outer door panel 10 and inner door panel 12 have been shown, with the inner door panel 12 being the base upon which the regulator mechanism parts are mounted. A mounting bracket 14 is shown bolted at its upper end to the window sill 13 of the inner door panel 12. The outer panel 10 and the inner panel 12 are spaced at their upper edges to form the opening, or slit, through which the window 16 moves.

Opposite the sill 13 is a polymer or rubber seal 11 extending along the upper edge of the lower outer door panel 10 which defines the lower boundary of the window opening. The upper edge of the lower outer door panel is fashioned as a lip or inturned flange 15. The lower portion of the window 16 has a U-shaped channel 18 along its lower edge which comprises part of the carrier for the window and is located directly above the flange 15 when in window fully closed position.

FIG. 1 shows the assembly of the whole regulator mechanism of this invention, comprising basically a closed loop flexible cable 20, a portion of which is wrapped around a driving drum 22. The drum 22 may be driven by an electric reversible motor 24 or by a hand crank 26. Thus, all movements of the window are caused by a pull in the cable in either direction. Another flexible drive element, such as a tape, may be used instead of the cable. The closed loop is provided with a vertical reach 28 which is guided along a vertical track 30 parallel to the vertical reach 28. The track is supported at its upper end by the bracket 14 and at its lower end by a bracket 34. The upper end of the track 30 and the bracket 34 support upper and lower guiding pulleys 36 and 38, respectively.

The track 30 includes a straight slot 40 extending from the bottom of the track to the top, where it terminates in slot end 41. Just below the top of the slot 40, a lateral slot arm 42 extends from the slot and curves upwardly to its end 43. A slide mechanism 44 rides on the track and is guided by the slot 40. FIG. 3 shows a front view of the mechanism 44 which includes a cable holder 46, in the form of a double grooved pulley, a plate 48 spaced from the holder 46, a shaft 50 extending between the holder 46 and the plate 48 and rotatably supporting a guide block 52 having hubs 53, a cam assembly 54 mounted on the end of the shaft 50, and a pin 56 extending between the plate 48 and the holder 46. The guide block 52 and pin 56 reside in the slot 40 to guide the slide mechanism 44 along the track 30 in response to movement of the cable 20.

Each end of the cable 20 partially surrounds one of the grooves 58 of the cable holder 46 and fittings 60 on the ends of the cable 20 are secured in notches 61 in the grooves. Movement of the cable 20 not only pulls the mechanism up and down the track, but also imposes a turning moment on the cable holder. The shaft 50, which is eccentrically mounted on the holder 46 defines the pivot axis of rotation 50*a*. The shaft 50 extends through the plate 48 to fixedly hold a cylindrical cam 62 of the cam assembly 54. The cam 62 has helical grooves 64 which are engaged by internal pins 66 on a cup-shaped cam follower 68. A lift arm 70 connects the cam follower 68 and the window channel 18 and prevents rotation of the follower. Thus, any rotation of the cam 62 occasioned by the rotation of the cable holder 46 will move the follower in the direction of the axis of the shaft 50, thereby moving the window 16 inwardly or outwardly.

Only limited rotation of the shaft 50 is possible, and the pin 56, which is also eccentrically mounted on the cable holder 46, prevents rotation of the holder when the pin is in the slot 40. The pin 56 has a large diameter body 72 and smaller diameter ends 74' fastened to the plate 48 and holder 46. If desired, a roller can be used in place of the fixed pin 56. As shown in FIG. 4A, the pin 56 is nearly as wide as the slot 40. Due to the rotational moment imposed on the cable holder 46 by the cable 20, the pin 56 is pressed against the left side of the slot 40 during window raising and against the right side during window lowering. The guide block 52, on the other hand is pressed against the right side of the slot 40 during window raising and against the left side during window lowering.

Figure 4B:
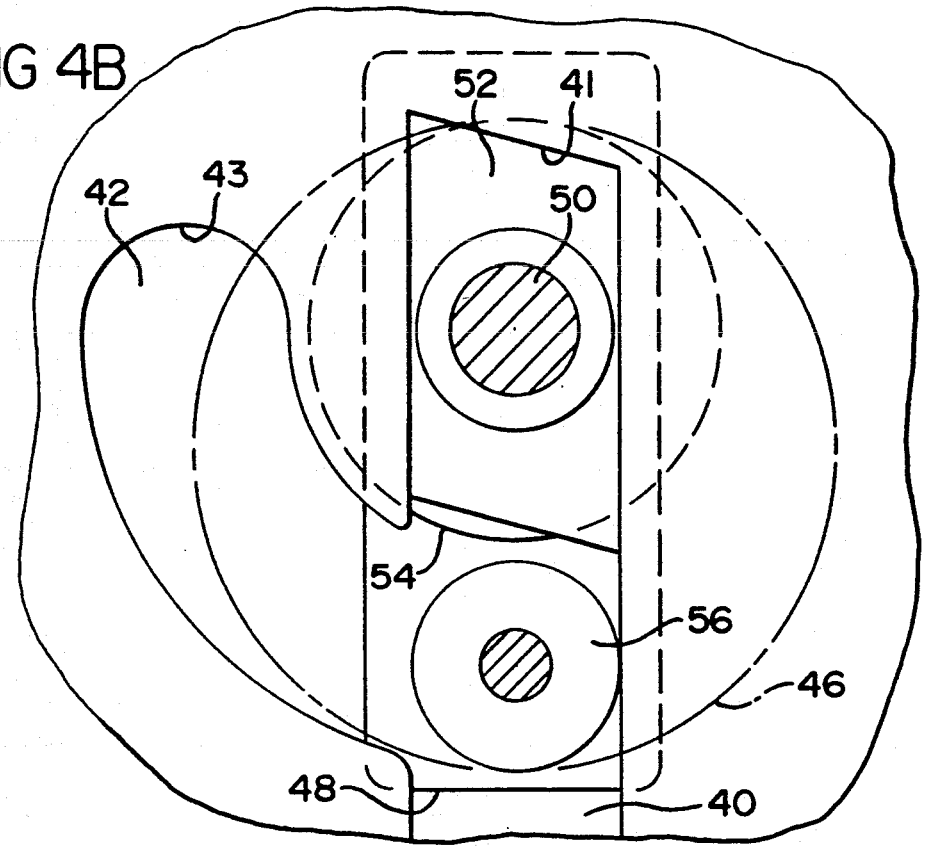
Figure 4C:
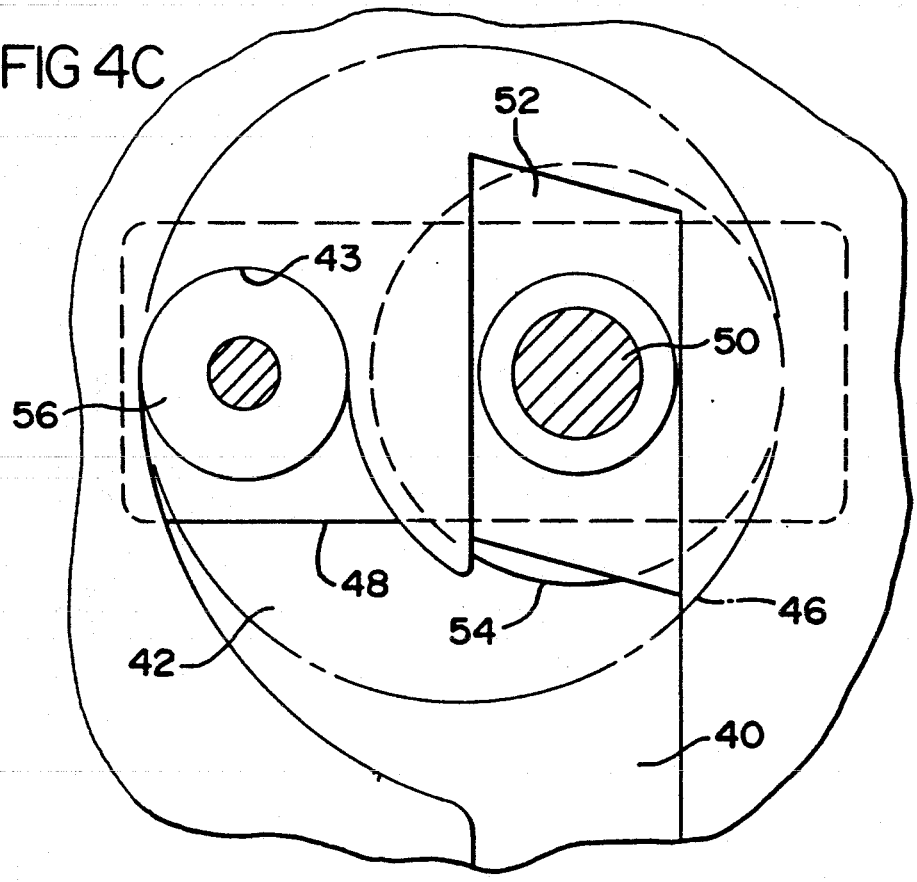

The guide block 52 is generally rectangular or a parallelogram and is substantially as wide as the slot 40 for sliding therein. The block 52 is long enough to bridge the arm 42 when it crosses the arm so that it will not enter the arm 42. FIG. 4A shows the slide mechanism 44 in the position where the block 52 is crossing the arm. FIG. 4B shows the slide mechanism in the uppermost position, where the guide 52 abuts slot end 41 and the pin 56 is in the slot 40. FIG. 4C shows the slide mechanism 44 in fully rotated position, wherein the pin 56 abuts the end 43 of the arm 42.

In operation, the window is raised by operating the cable 20 to pull the slide mechanism 44 up the track 30. When the guide block 52 abuts the top 41 of the slot 40, the window is in its highest position and the pin 56 is aligned with the junction of the arm 42 and slot 40 (FIG. 4B). Further upward movement of the cable 20 causes rotation of the cable holder 46 about the axis of shaft 50 to move the pin 56 into the slot until the pin abuts the end 43 of the slot (FIG. 4C). During the rotation of the cable holder 46, the shaft 50 and the cam 62 are also rotated to cam the follower 68 away from the track 30 to move the window 16 outwardly.

Thus, the point A on the channel 18 (FIG. 2) follows the path B, moving first vertically and then horizontally to clear the flange 15 or other structure which may extend in from the edge of the opening. The motion is reversed, following the same orthogonal path, to lower the window. When the cable 20 pulls down to rotate the cable holder 46, the pin 56 moves back to the slot 40 causing the cam 62 to rotate and pull the window inwardly. Then further downward movement of the cable 20 pulls the slide mechanism 44 down the track 30 to lower the window.

It will thus be seen that orthogonal movement of the bottom of a window is accomplished by a regulator which is compact and which has few operating parts.

I claim:

1. A window regulator for imparting vertical and horizontal movement to a vertical window, comprising:

a vertical track mounted on the vehicle and having an elongated slot and a slot arm branching from the elongated slot to one side at a point spaced below the top end of the elongated slot, a slide mechanism mounting the lower end of the window and being slidable in the elongated slot to raise and lower the window, the slide mechanism including an upper guide received in the elongated slot, a lower guide received in the elongated slot and spaced below the upper guide so as to register with the slot arm when the upper slide is at the upper end of the elongated slot, rotating means mounting the lower guide on the upper guide for rotation about a pivot axis, and a cam mechanism mounting the window for horizontal movement upon rotation of the rotating means, and drive means including a drive mechanism and a flexible drive member having a vertical reach adjacent the track, the flexible drive member interconnecting the drive mechanism and the rotating means, the drive means being operable to move the slide mechanism in the slot to raise and lower the window, and imparting a rotational moment on the rotating means to enable rotation only when the upper guide is seated at the upper end of the elongated slot, and the lower guide into the slot arm and causes the cam mechanism to move the window horizontally.

2. The invention as defined in claim 1, wherein the slide mechanism includes a shaft on the pivot axis and wherein the rotating means and cam mechanism are mounted on the shaft for rotation together and the upper guide means is rotatably mounted on the shaft between the rotating means and the cam mechanism.

3. The invention as defined in claim 1, wherein the upper guide is larger in the direction of the slot than the width of the slot arm for bridging the slot arm during movement to and from the upper end of the slot.

4. The invention as defined in claim 1, wherein the rotating means is a pulley eccentrically rotatable about the pivot axis and the flexible drive member is wrapped at least part way around the pulley to provide a vertical force and a rotational moment on the pulley.

* * * * *

UNITED STATES PATENT AND TRADEMARK OFFICE

CERTIFICATE OF CORRECTION

PATENT NO. : 5,081,792
DATED : January 21, 1992
INVENTOR(S) : Mark A. Huebner

It is certified that error appears in the above-indentified patent and that said Letters Patent is hereby corrected as shown below:

Col. 4, line 52, "vertical" should read --vehicle--.

Col. 5, line 14, "the lower guide into the slot arm" should read --the lower guide is the moved into the slot arm--.

Col. 6, line 9, "for bridging the slot arm" should read --for bridging the slot arm during movement--.

Col. 6, line 10, "from the upper end of the slot." should read --from the upper end of the elongated slot.--.

Signed and Sealed this
Third Day of August, 1993

*Attest:*

*Attesting Officer*

Michael K. Kirk

MICHAEL K. KIRK

*Acting Commissioner of Patents and Trademarks*